US006349584B1

(12) United States Patent
Kretz et al.

(10) Patent No.: US 6,349,584 B1
(45) Date of Patent: Feb. 26, 2002

(54) APPARATUS FOR CURLING SHELLS FOR BEVERAGE CONTAINERS

(75) Inventors: Thomas J. Kretz; Michael W. Farmer, both of Beavercreek, OH (US)

(73) Assignee: Precision Machining Services, Inc., Dayton, OH (US)

( * ) Notice: Subject to any disclaimer, the term of this patent is extended or adjusted under 35 U.S.C. 154(b) by 0 days.

(21) Appl. No.: 09/572,245

(22) Filed: May 17, 2000

(51) Int. Cl.[7] ..... B21D 51/54
(52) U.S. Cl. ..... 72/93; 72/94
(58) Field of Search ..... 72/92, 93, 94, 72/452.7

(56) References Cited

U.S. PATENT DOCUMENTS

| | | | | |
|---|---|---|---|---|
| 1,945,579 A | * | 2/1934 | Thoma | 72/93 |
| 2,245,042 A | * | 6/1941 | Merolle | 72/94 |
| 4,561,280 A | | 12/1985 | Bachmann et al. | |
| 4,567,746 A | | 2/1986 | Bachmann et al. | |
| 4,574,608 A | | 3/1986 | Bulso, Jr. et al. | |
| 4,977,772 A | | 12/1990 | Bulso, Jr. et al. | |
| 5,287,718 A | | 2/1994 | Yamanashi | |
| 5,491,995 A | | 2/1996 | Stodd | |
| 5,669,259 A | | 9/1997 | Stodd | |

* cited by examiner

*Primary Examiner*—Lowell A. Larson
(74) *Attorney, Agent, or Firm*—Porter, Wright, Morris & Arthur

(57) ABSTRACT

An improved curling apparatus for curling the outer peripheries of container shells includes a plurality of inner rings vertically stacked and a plurality of outer ring-segments vertically stacked. Each of the inner rings have an outer surface and a groove in the outer surface which extends the entire periphery of the inner ring. Each of the outer ring-segments has an inner surface and a groove in the inner surface which extends the length of the outer ring-segment. The outer ring-segments partially encircle the inner rings with the inner ring grooves facing the outer ring-segment grooves. Each of outer ring-segments preferably has a unitary length extending about 240 degrees and an eccentric groove. The curling apparatus also includes a plurality of adjustment devices adapted to selectively move the outer ring segments relative to the inner rings to adjust a distance between the inner ring groove and the outer ring-segment groove at a desired location along the outer ring-segment groove. Each outer ring-segment has one of the adjustment devices associated therewith. Each adjustment device includes a pair of a cam members located on opposite sides of the outer ring-segment. Each cam member is rotatable about a vertical axis and is located within vertically extending openings in the outer ring-segments. One of the openings associated with the cam member is in an associated outer ring-segment and is engaged by the cam member, while the remaining openings associated with the cam member in the other outer ring-segments are clearance openings. The outer ring-segments are secured with common mounting fasteners which extend through the clearance openings in each of the outer ring-segments. The adjustment devices permit each of the outer ring-segments to be individually and precisely positioned without removing the other outer ring-segments.

23 Claims, 5 Drawing Sheets

APPARATUS FOR CURLING SHELLS FOR BEVERAGE CONTAINERS

FIELD OF THE INVENTION

The present invention generally relates to an apparatus for producing ends or shells for can-type containers such as beverage containers or the like and, more particularly, to a forming apparatus for curling a periphery of the shells.

BACKGROUND OF THE INVENTION

Individual components of a two-part beverage container typically include a unitary deep drawn cup or body which terminates in an outwardly extending curl and an end or shell which has a peripheral inwardly extending curl. The body and shell curls are connected in a seaming operation to attach the shell to the body with a hermetic seal. The shell is typically provided with a self-opening structure such as a tear tab and related score lines to provide access to the contents of the container. The components are typically manufactured from a suitable metal such as, for example, aluminum or steel.

The shell is conventionally produced by a two step process: (1) punching and forming a strip of sheet metal into a shell using a press; and (2) curling an outer periphery of the shell using a forming or curling apparatus. The curling apparatus often consists of a rotating wheel having an inner ring or die and a stationary base having a plurality of outer ring-segments or dies. Typically, four to six outer ring-segments are provided to collectively extend about 240 degrees. The inner ring has an inner groove and the outer ring-segments together form an outer groove for forming curls on the periphery of the shells. As the wheel rotates, the shells pass between the inner and outer grooves. The distance between the inner and outer grooves gradually narrows so that the curls are formed as the shells pass therebetween. The groove formed by the outer ring-segments is typically eccentric to the rotational axis of the wheel so that the shells rotate as they pass between the inner and outer grooves. To increase production of the curling apparatus, the inner rings and outer ring-segments are often stacked to form a plurality of levels.

U.S. Pat. Nos. 5,491,995 and 5,669,259 to Stodd disclose a curling apparatus for high speed production of shells for beverage containers, the disclosures of which are expressly incorporated herein in their entirety by reference. The curling apparatus utilizes six outer ring-segments which are positioned opposite each inner ring. A series of peripherally spaced adjustment screws project radially inward through a flange to engage the ring-segments for precisely adjusting the radial position of each ring-segment. The ring-segments are precisely positioned using the adjustment screws to obtain the desired eccentricity of the outer groove formed by the ring segments and the desired narrowing of the distance between the inner and outer grooves. Each level of outer ring-segments is bolted directly to the level directly below.

While such a curling apparatus may suitably curl the shells during operation, it has numerous shortcomings with regard to set-up and tear-down requirements. Adjusting the position of each of the outer ring-segments to obtain the desired eccentricity and diameter is very time consuming. This problem is further exacerbated when multiple levels are utilized because each level is built onto, that is bolted to, the preceding level. To adjust a level, each of the levels located above that level must be removed. It is common for production to be stopped a week for set-up of about eight sets of ring-segments. This is particularly a problem because the grooves must be cleaned regularly to remove debris such as, for example anodizing and the ring-segments of upper levels must be removed to access all of the grooves. Accordingly, there is a need in the art for an improved curling apparatus which requires reduced tear-down and set-up time compared to prior art systems and/or permits adjustment to each level without disassembly of the other levels.

SUMMARY OF THE INVENTION

The present invention provides a curling apparatus which overcomes at least some of the above-noted problems of the related art. According to the present invention, a die for curling outer peripheries of container shells includes a unitary ring segment having an inner surface. The ring segment has a length extending in the range of about 120 degrees to about 300 degrees. A groove is provided in the inner surface and extends the length of the ring segment. The groove sized and shaped to form the container shells. According to a preferred embodiment, the unitary ring segment has a length extending about 240 degrees. By utilizing a unitary ring segment according to the present invention, set-up time of a curling apparatus is substantially reduced because the position of only a single ring-segments needs to be adjusted.

According to another aspect of the present invention, a die for curling outer peripheries of container shells includes a unitary ring segment having an inner surface and a groove provided in the inner surface and extending the length of the ring segment. The groove is sized and shaped to form the shells and the groove is eccentric. By utilizing a unitary ring segment with eccentricity built-in according to the present invention, set-up time of a curling apparatus is substantially reduced because multiple ring segments do not have to be adjusted to obtain eccentricity.

According to yet another aspect of the present invention, a curling apparatus for curling outer peripheries of container shells includes an inner ring having an outer surface and a groove in the outer surface and an outer ring-segment having an inner surface and a groove in the inner surface. The inner ring groove extends the entire periphery of the inner ring. The outer ring-segment groove extending the length of the outer ring-segment. The outer ring-segment partially encircles the inner ring with the inner ring groove facing the outer ring-segment groove. The curling apparatus also includes an adjustment device adapted to selectively move the outer ring segment relative to the inner ring to adjust a distance between the inner ring groove and the outer ring-segment groove at a desired location along the outer ring-segment groove. The adjustment device includes a rotatable cam member. In a preferred embodiment, the cam member is rotatable about a vertical axis and is located in a vertically extending opening in the outer ring segment. By utilizing an adjustment device according to the present invention, the position of the outer ring-segment can be easily and precisely adjusted from a desired location.

According to even yet another aspect of the present invention, a curling apparatus for curling outer peripheries of container shells includes a plurality of inner rings vertically stacked and a plurality of outer ring-segments vertically stacked. Each of the inner rings have an outer surface and a groove in the outer surface. Each inner ring groove extends an entire periphery of the inner ring. Each of the outer ring-segments has an inner surface and a groove in the inner surface. Each outer ring-segment groove extends the length of the outer ring-segment. The outer ring-segments partially encircle the inner rings with the inner ring grooves facing the outer ring-segment grooves. The curling apparatus also includes plurality of adjustment devices adapted to selectively move the outer ring segments relative to the inner rings to adjust a distance between the inner ring groove and the outer ring-segment groove at a desired location along the outer ring-segment groove. Each outer ring-segment has one of the adjustment devices associated therewith. Each adjustment device includes a cam member rotatable about a vertical access and located within vertically extending openings in the outer ring-segments. Preferably, one of the openings associated with the cam member is in an associated outer ring-segment and is engaged by the cam member and the remaining openings associated with the cam member are clearance openings. The outer ring-segments are preferably secured with common mounting fasteners which extend through clearance openings in each of the outer ring-segments. By utilizing a an adjustment device according to the present invention, the position of any of the outer ring-segments can be easily and precisely adjusted from a desired location without removal of any of the other outer ring segments.

From the foregoing disclosure and the following more detailed description of various preferred embodiments it will be apparent to those skilled in the art that the present invention provides a significant advance in the technology and art of apparatus for curling container shells. Particularly significant in this regard is the potential the invention affords for providing an easy-to-use, high quality, feature-rich, low cost system. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 1:
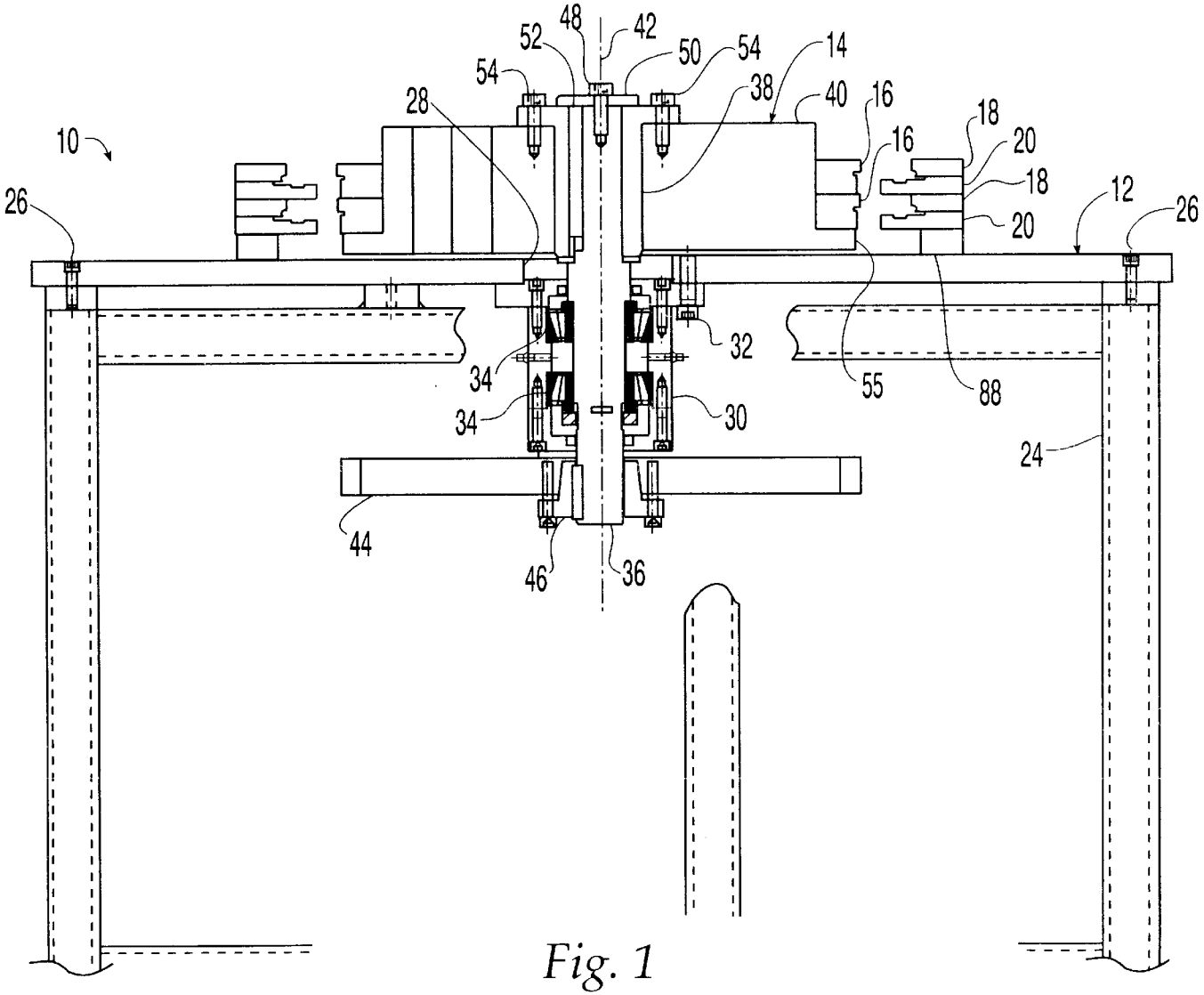
FIG. 1 is an elevational view, partially in cross, section, of a curling apparatus according to a preferred embodiment of the present invention wherein some components are removed for clarity.

It should be understood that the appended drawings are not necessarily to scale, presenting a somewhat simplified representation of various preferred features illustrative of the basic principles of the present invention. The specific design features of a curling apparatus as disclosed herein, including, for example, specific shapes of the forming grooves will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the curling apparatus illustrated in the drawings. In general, up or upward refers to an upward direction in the plane of the paper in FIG. 1 and down or downward refers to a downward direction in the plane of the paper in FIG. 1.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved curling apparatus disclosed herein. The following detailed discussion of various alternative and preferred embodiments will illustrate the general principles of the invention with reference to a curling apparatus for shells of beverage cans. Other embodiments suitable for other applications will be apparent to those skilled in the art given the benefit of this disclosure. The term "Unitary" as used herein and in the claims, means a single item or body, for example, a body formed or machined from a single piece of material or a body formed by rigidly connecting a plurality of sub-components so that they move together as a single body.

Figure 3:
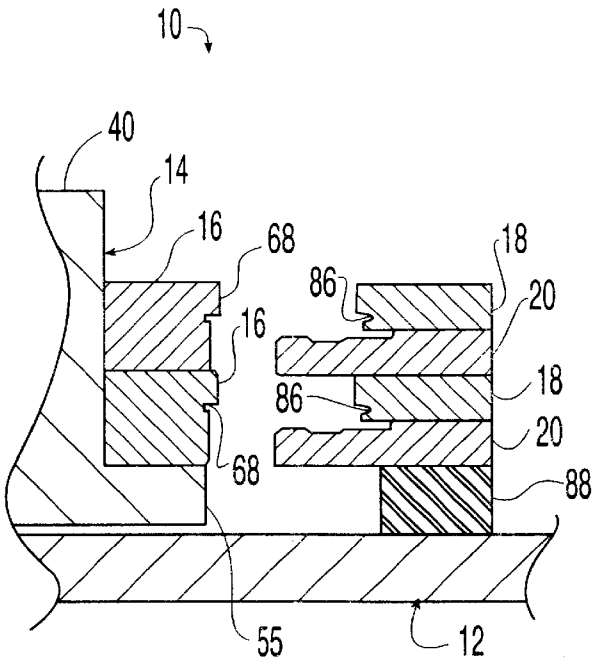
FIG. 3 is a cross-sectional view taken along line 3—3 of FIG. 2 showing two levels each having one of the inner rings and one of the outer ring-segments.
Figure 2:
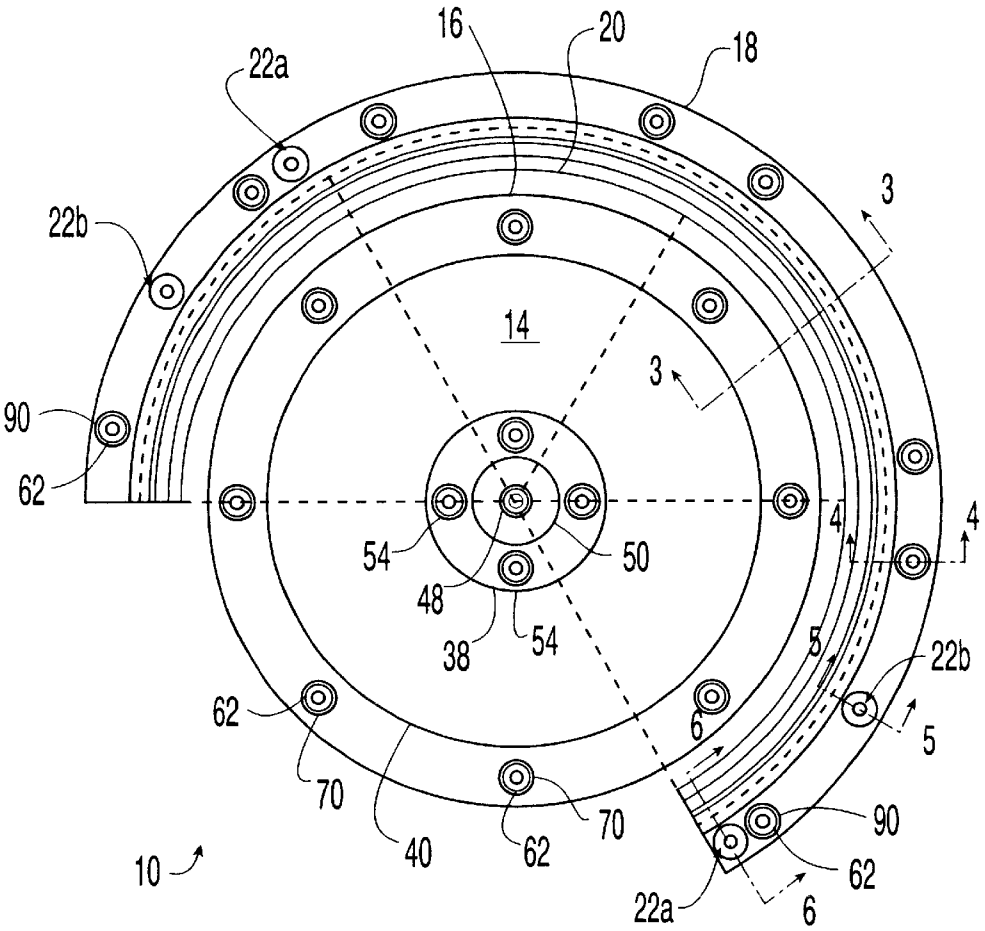
FIG. 2 is a top plan view of a portion of the curling apparatus of FIG. 1 showing a stack of inner dies or rings and a cooperating stack of outer dies or ring-segments.
Figure 13:
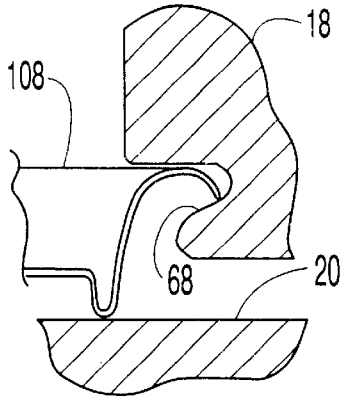
FIG. 13 is a cross-sectional view showing the outer periphery of a shell engaging an outer ring-segment near an entrance of the outer ring segment.
Figure 14:
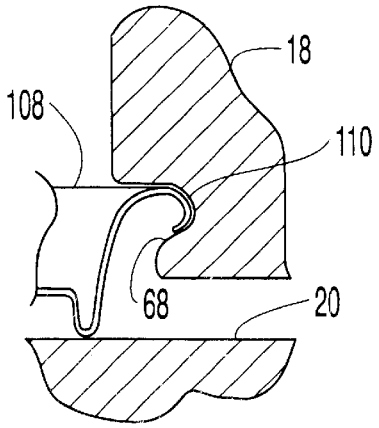
FIG. 14 is a cross-sectional view similar to FIG. 13 but showing the shell near an exit of the outer ring segment.

Referring now to the drawings, FIGS. 1 to 3 illustrate a curling apparatus 10 according to the present invention. The curling apparatus 10 includes a stationary base 12, a rotatable curling wheel 14 supported by the base 12, a plurality of stacked inner rings or dies 16, a plurality of stacked unitary outer ring-segments 18 for cooperating with the inner rings 16 to curl container shells, a plurality of support rails 20, and a plurality of adjustment devices 22 for adjusting positions of the outer ring-segments 18. It is noted that while the illustrated curling apparatus 10 utilizes two levels of dies 16, 18, a lesser or greater number of levels is within the scope of the present invention.

The illustrated base 12 is a generally planar member supported above the ground by a platform 24 in a table-like manner. The base 12 is rigidly secured to the platform 24 in any suitable manner such as, for example, the illustrated bolts 26. The base 12 has a central opening 28 formed therein and a vertically extending hub portion 30 which encircles the opening 28 and downwardly extends from the base 12. The hub portion 30 is rigidly secured to the base 12 in any suitable manner such as, for example, the illustrated bolts 32. The hub portion 30 retains a pair of axially spaced-apart anti-friction bearings 34 for rotatably supporting the curling wheel 14 as described in more detail herein below.

The curling wheel 14 includes a shaft portion 36, a hub portion 38 and a rim portion 40. The shaft portion 36 vertically extends through the opening 28 of the base 12 and into the hub portion 30 of the base 12 where it cooperates with the anti-friction bearings 34 in a known manner. Mounted in this manner the shaft portion 36 is rotatable, relative to the base 12, about a substantially vertical axis of rotation 42. A drive pulley or sheave 44 is secured to the lower end of the shaft portion 36 for rotation therewith. The illustrated drive pulley 44 is secured to the shaft portion by a bushing 46 keyed to the shaft portion 36. The shaft portion 36 is preferably driven by an electric motor connected the drive pulley 44 through a drive belt or the like. It is noted that the drive mechanism for rotating the curling wheel 14 can take many forms within the scope of the present invention. The hub portion 38 receives the upper end of the shaft portion and is rigidly connected so that the hub portion 38 is rotatable with the shaft portion 36. The illustrated hub portion 38 is secured to the shaft portion 36 by a bolt 48, a washer or plate 50, and a key 52 in a known manner. The rim portion 40 radially extends from the hub portion 38 above the base 12 and is rigidly secured to the hub portion 40 for rotation therewith. The rim portion 40 can be secured to hub portion 38 using any suitable manner such as, for example, the illustrated bolts 54. The periphery of the rim portion 40 is provided with a lower flange 55 which forms a support surface for the inner rings 16. The outer cylindrical surface of the rim portion 40 is preferably stepped to correspond with unique inner diameters of the inner rings 16 of the different levels.

Figure 4:
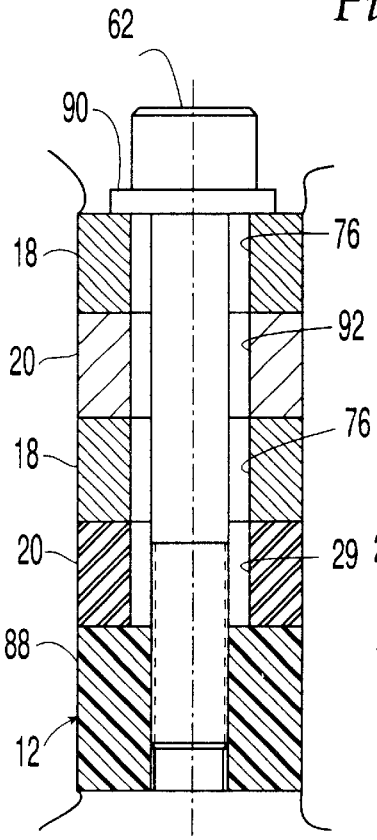
FIG. 4 is a cross-sectional view taken along line 4—4 of FIG. 2 showing a mounting bolt for the stack of outer ring-segments.
Figure 10:
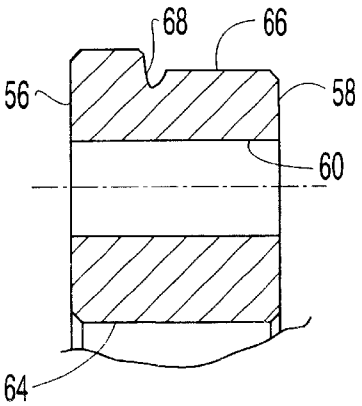
FIG. 10 is an enlarged fragmented view of a portion of FIG. 9 as defined by line 10—10.
Figure 9:
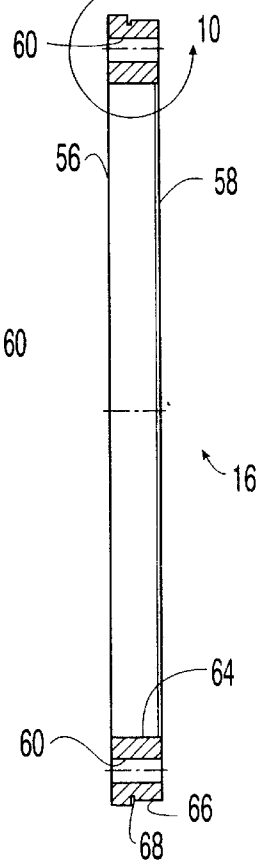
FIG. 9 is a cross sectional view taken along line 9—9 of FIG. 8.
Figure 8:
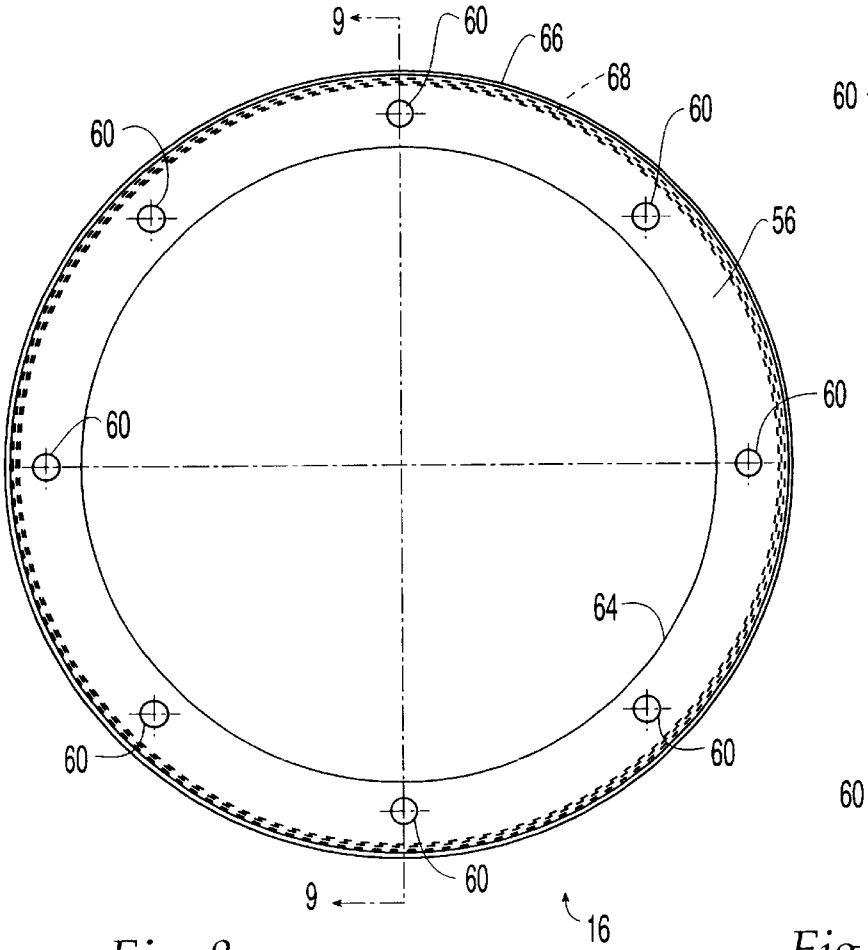
FIG. 8 is a plan view of an inner ring of the curling apparatus of FIGS. 1 to 7.

As best shown in FIGS. 8 to 10, each inner ring or die 16 is annular or ring shaped by extending a full 360 degrees. The inner ring 16 has substantially planar upper and lower surfaces 56, 58 such that the inner rings 16 can be vertically stacked one upon another. The height of the inner ring 16 is sized to precisely correspond with the combined thickness of the outer ring-segment 18 and the support rail 20 as described in more detail hereinafter. It is noted that shims can be utilized to adjust the spacing as required. The illustrated inner ring is provided with a plurality of circumferentially spaced-apart clearance openings 60 extending between the upper and lower surfaces 56, 58 which are sized for receiving mounting bolts (FIGS. 2 and 4). The inner ring 16 has a cylindrically-shaped inner surface 64 sized to cooperate with the curling wheel rim portion 40 at the appropriate stepped portion of the outer surface of the curling wheel rim portion 40. An outer surface 66 of each inner ring is provided with a uniform groove 68 extending out its entire periphery. The groove 68 is sized and shaped to receive the peripheral lip of the shells.

As best shown in FIGS. 1 to 3, the inner rings 16 are stacked one on the other and are supported on the lower flange 55 of the curling wheel rim portion 40. Stacked in this manner, the grooves 68 are coaxial and axially spaced apart. The inner rings 16 are secured to the curling wheel rim portion 40 by a plurality of bolts 62 with washers 70 which vertically extend through the clearance openings 60 (FIGS. 8–10) of each of the inner rings 16 to the lower flange 55 of the curling wheel rim portion 40.

Figures 11, 12:
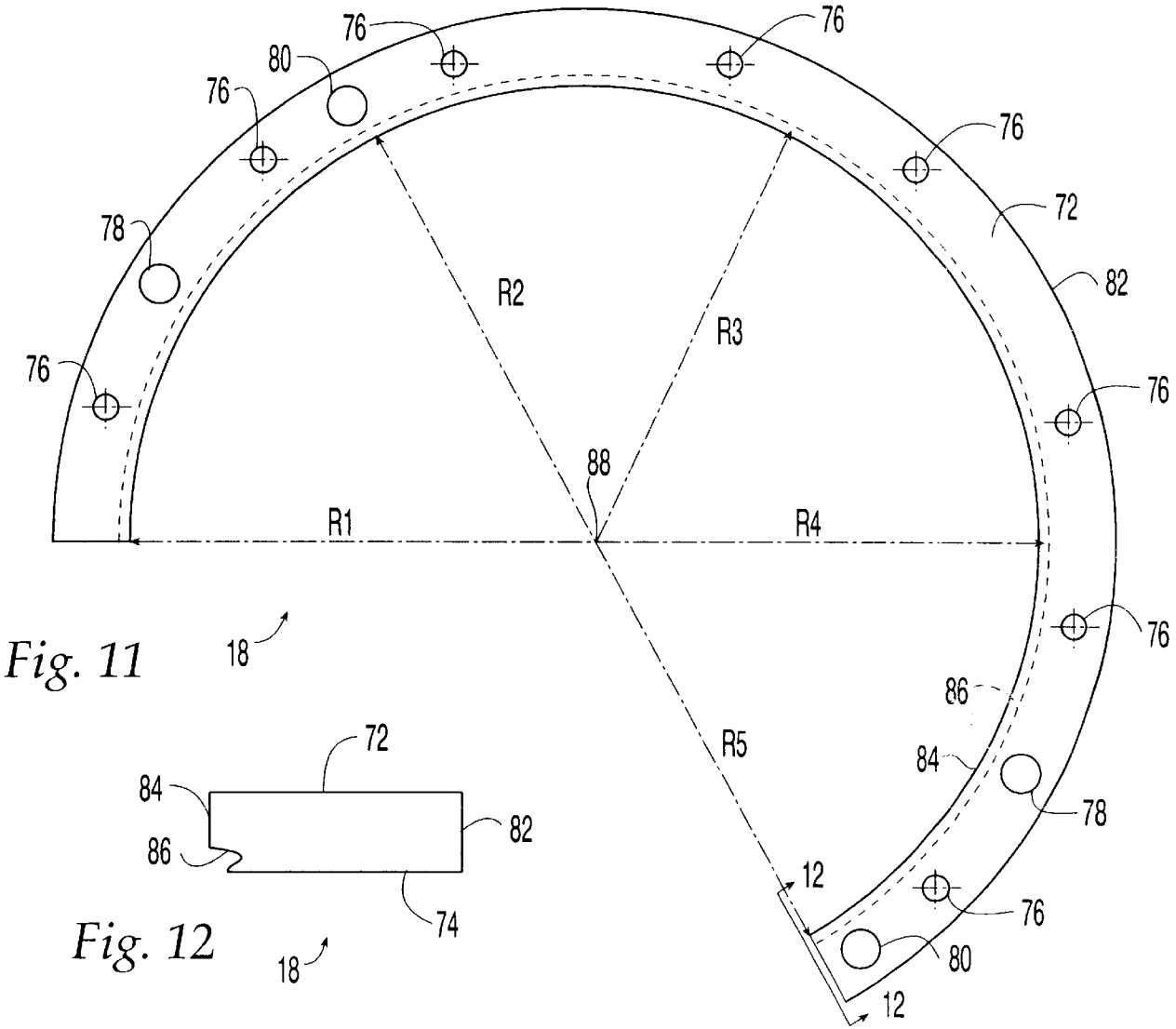
FIG. 11 is a plan view of an outer ring segment of the curling apparatus of FIGS. 1 to 7.
FIG. 12 is an elevational view of the end of the outer ring segment of FIG. 11.

As best shown in FIGS. 11 and 12, each unitary outer ring-segment 18 is partially annular or ring shaped extending less than 360 degrees. Each outer ring-segment 18 preferably extends a distance in the range of about 120 degrees to about 360 degrees, more preferably in the range of about 180 degrees to about 300 degrees, and most preferably about 240 degrees. The outer ring-segment 18 has substantially planar upper and lower surfaces 72, 74 such that the outer ring-segments 18 can be vertically stacked one upon another. The height of the outer ring-segment 18 is sized to combine with the support rail 20 to precisely correspond with the thickness of the inner ring 16 as described in more detail hereinafter. It is noted that shims can be utilized to adjust spacing as required. The illustrated outer ring-segment 18 is provided with a plurality of circumferentially spaced apart clearance openings 76 extending between the upper and lower surfaces 72, 74 which are sized for receiving mounting bolts 78 (FIGS. 2 and 4). The illustrated outer ring-segment 18 is also provided with a pair of elongated openings or slots 78 which are located on opposite sides of the outer ring-segment 18, that is circumferentially spaced apart about 180 degrees, and extend between the upper and lower surfaces 72, 74. The slots 78 are sized and shaped for cooperating with the adjustment device 22 as described in more detail hereinafter. One of the slots 78 is preferably located near the exit of the outer ring-segment 18 such as, for example, in the last 60 degrees of the outer ring-segment 18. The illustrated outer ring-segment 18 is also provided with a pair of clearance openings 82 which are located on opposite sides of the outer ring-segment, that is circumferentially spaced apart about 180 degrees, and extend between the upper and lower surfaces 72, 74. The clearance openings 82 are sized and shaped to cooperate with the adjustment device 22 of the outer ring-segment 18 of the other level. It is noted that the illustrated outer ring-segment 18 is adapted for the second layer, but it is essentially the same as the outer ring-segment 18 for the first layer except that the locations of the slots 78 and the clearance openings 80 are reversed. It is also noted that when there are more than two levels, additional clearance openings 80 are provided for additional adjustment devices 22. An outer surface 82 of the outer ring-segment is generally cylindrically shaped.

An inner surface of 84 of the outer ring-segment 18 is provided with a groove 86 extending the entire length of the outer ring segment 18. The groove 86 is sized and shaped to receive the peripheral lips of the shells. The groove 86 is eccentric to the central axis 88, that is, the radius of the groove 86 is not constant over the length of the outer ring-segment 18. Preferably, the radius decreases from the entrance of the groove 86 to the exit of the groove 86. However, the radius of the groove 86 is preferably constant over the last portion of the groove 86, such as for about 60 degrees. For example, the groove 86 can have a radius (R1) of about 11.880 inches at the beginning of a first 60 degree segment, a radius (R2) of about 11.814 inches at the beginning of a second 60 degree segment, a radius (R3) of about 11.790 inches at the beginning of a third 60 degree segment, a radius (R4) of about 11.762 inches at the beginning of a fourth 60 degree segment, and a radius (R5) of about 11.762 inches at the end of the fourth 60 degree segment.

As best shown in FIGS. 1 to 3, the outer ring-segments 18 and the rail supports 20 are alternately stacked and supported on a spacer 89 secured to the base 12 such that the outer ring-segments 18 partially encircle the inner rings 20. Stacked in this manner, the grooves 86 of the outer ring-segments 18 are coaxial and axially spaced apart and are located opposite the grooves 68 of the inner rings 16. The rail supports 20 inwardly extend into the annular space formed between the inner rings 16 and the outer ring-segments 18 to prevent bowing of the shells as the curl is formed on the periphery thereof. As best shown in FIG. 4, the rail supports 20 and the outer ring-segments 18 are secured to the base 12 by a plurality of bolts 62 with washers 90 which vertically extend through clearance openings 76, 92 of both of the outer ring-segments 18 and the rail supports 20 to the base 12.

Figure 7A:
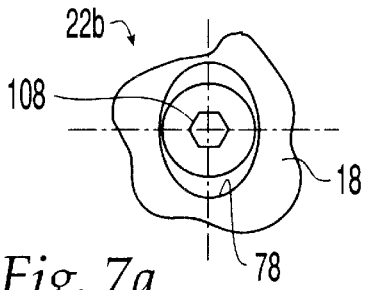
FIG. 7*a* is an enlarged fragmented top plan view of the adjustment device for the outer ring-segment of level two shown in FIG. 5.
Figure 7B:
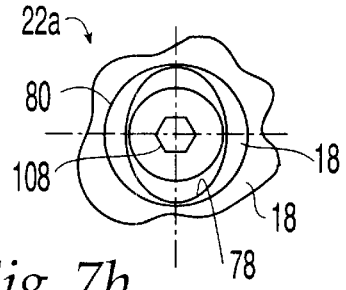
FIG. 7*b* is an enlarged fragmented top plan view of the adjustment device of the outer ring-segment of level one shown in FIG. 6.
Figure 5:
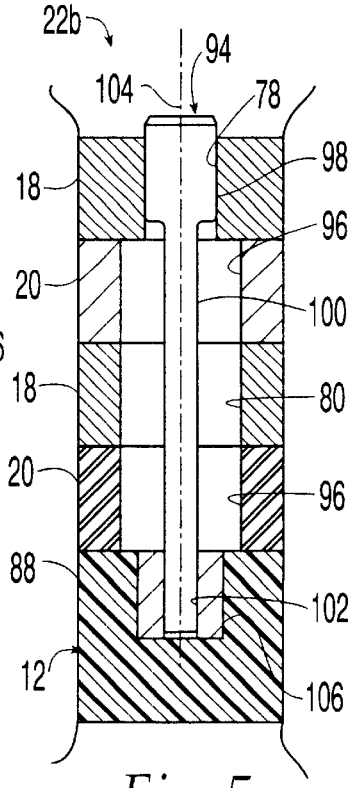
FIG. 5 is a cross sectional view taken along line 5—5 of FIG. 2 showing a portion of an adjustment device for the outer ring-segment of level two.
Figure 6:
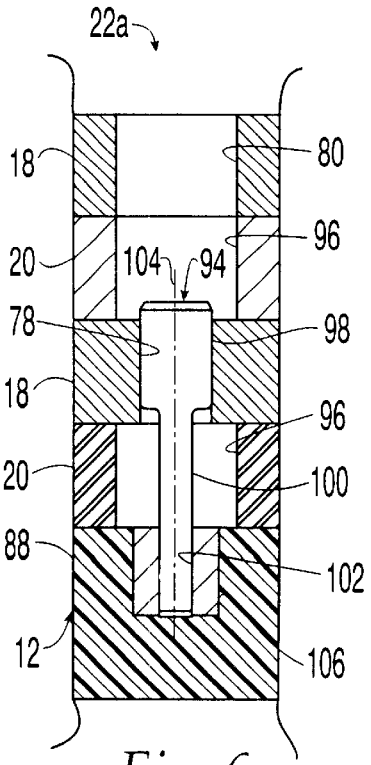
FIG. 6 is a cross sectional view taken along line 6—6 of FIG. 2 showing a portion of an adjustment device for the outer ring-segment of level one.

As best shown in FIGS. 2, 5, and 7, the adjustment device 22*a* for the first level outer ring-segment 18 and the adjustment device 22*b* for the second level outer ring-segment 18 each include a pair of rotatable cam members 94 which are located on opposite des of the outer ring-segments 18, that is substantially 180 degrees apart, within the slots and clearance openings 80 of the outer ring-segments 18. It is noted that each rail support 20 is also provided with suitable clearance openings 96 similar to the clearance openings of the outer ring-segments 18. Each cam member 94 is provided with a cam portion 98 at an upper end and a shaft or dowel portion 100 extending therefrom. The lower end of the dowel portion 100 is received and rotatably supported in an opening 102 formed in the base 12 such that the cam member 94 is freely rotatable about its central axis 104. In the illustrated embodiment, the base 12 is provided with a suitable bushing 106 to rotatably support the cam member 94. A cam surface of the cam portion 98 engages the inner surface of the outer ring-segment slot 78. The upper end of the can member 94 is preferably adapted for rotation by a suitable tool. The illustrated cam member is provided with a hexagonically-shaped cavity 108 shaped for receipt of a hex key or wrench.

The cam surface is eccentric to the vertical rotational axis 104 of the cam member 94, that is, the radial distance from the rotational central axis 104 to the cam surface varies. The cam surface is sized and shaped along with the slots 78 of the outer ring-segment 18 so that rotation of the cam portion 98 about its fixed rotational axis 104, horizontally moves or translates the outer ring-segment 18 linearly toward the cooperating cam member 94 located on the opposite side of the outer ring-segment 18. It is noted that as the cam member 94 is rotated to push the outer ring-segment 18, that is, rotate the cam surface such that a larger radius portion of the cam surface engages the inner surface of the slot 78, the cooperating cam member 94 on the opposite side of the outer ring-segment 18 automatically rotates to accommodate such movement, that is, rotates such that a smaller radius portion of the cam surface engages the inner surface of the slot 78. To move the outer ring-segment 18 in the opposite direction, the cooperating cam member 94 on the opposite side of the outer ring-segment 18 is rotated in the same manner to push the outer ring-segment 18 back in the opposite direction.

As best shown in FIGS. 5 and 7, the height of each cam member 94 is sized such that the cam surface engages the desired outer ring segment 18, that is, the higher the level of the outer ring-segment 18 the taller the cam member 94. The clearance openings 80, 96 in the other outer ring-segments 18 and the support rails 20 permit free rotation of the fixed axis cam members 96.

To adjust the position of one or each of the outer ring-segments 18, the mounting bolts 62 are loosened. To adjust the outer ring-segment 18 of the first level, the appropriate one of the cam members 94 of the adjustment device 22*a* is rotated using a hex wrench to push or linearly translate the outer ring-segment 18 in the desired direction to obtain a desired distance between the grooves 68, 86 near the exit of the outer ring-segment 18. It is noted that eccentricity of the groove 86 does not have to be adjusted because it is built-into the groove 86 of the outer ring-segment 18 as discussed hereinabove. The outer ring-segment 18 freely moves relative to the mounting bolts 62 because of the clearance openings 76. It is noted that the outer ring-segment 18 of the second level, or any other level which is provided, remains in place and is not removed to adjust the outer ring-segment 18 of the first level. While the mounting bolts 62 are loose, the outer ring segments are held in its position by the cam members 94 of the adjustment devices 22. The position of the outer ring-segment of the second level or any other level which may adjusted in the same manner. After the position of the outer ring-segments 18 is adjusted as desired, the mounting bolts 62 are tightened.

As best shown in FIGS. 2, 3, 13, and 14, container shells 108 are fed between the inner ring 16 and the outer ring segment 18 in the grooves 68, 86 at the entrance of the outer ring-segment 18. The rotating inner ring 16 carries the container shells 108 around to the exit of the outer ring-segment 18 where they are discharged from the grooves 68, 86. The eccentricity of the outer ring-segment groove 68 causes the container shells 108 to rotate or spin numerous times as they move the length of the outer ring-segment 18. When the container shells 108 enter the outer ring-segment groove 68, the outer periphery is not curled or is only slightly curled (best shown in FIG. 13). As the container shells 108 travel along the outer ring-segment 18, the distance between the grooves 68, 86 decreases and the outer peripheries of the container shells 108 are rolled or formed and have a desired inwardly extending curl 110 when they exit the outer ring segment 18 (best shown in FIG. 14). It is noted that the curl 110 is primarily formed in the last portion of the outer-ring segment groove 68, such as the fmal 60 degree segment in the illustrated embodiment.

From the foregoing disclosure and detailed description of certain preferred embodiments, it will be apparent that various modifications, additions and other alternative embodiments are possible without departing from the true scope and spirit of the present invention. For example, it will be apparent to those skilled in the art, given the benefit of the present disclosure, that the outer ring-segment 18 can have many different dimensions and the groove 68 therein can have many different forms. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A die for curling outer peripheries of container shells comprising:

a unitary ring segment having an inner surface, the ring segment having a length extending in the range of about 120 degrees to about 300 degrees;

a groove in the inner surface and extending the length of the ring segment, the groove sized and shaped to form the shells;

wherein the unitary ring segment has a central axis; and wherein said groove has an entrance at a first end of the unitary ring segment and an exit at a second end of the unitary ring segment and a radius between the central axis and the groove decreases from the entrance to the exit.

2. The die according to claim 1, wherein the ring segment has a length extending in the range of about 180 to about 300 degrees.

3. The die according to claim 1, wherein the ring segment has a length extending about 240 degrees.

4. The die according to claim 1, wherein the groove has a last portion located at the exit and the radius between the central axis and the groove is constant over the portion of the groove.

5. A die for curling outer peripheries container shells comprising:

a unitary ring segment having an inner surface;

wherein the unitary ring segment has a central axis about which the inner surface uniformly extends;

a groove in the inner surface and extending the length of the ring segment, the groove sized and shaped to form the shells; and wherein the groove is eccentric to the inner surface.

6. The die according to claim 5, wherein the ring segment has a length extending in the range of about 120 to about 300 degrees.

7. The die according to claim 5, wherein the ring segment has a length extending in the range of about 180 to about 300 degrees.

8. The die according to claim 5, wherein the ring segment has a length extending about 240 degrees.

9. The die according to claim 5, wherein said groove has an entrance at a first end of the unitary ring segment and an exit at a second end of the unitary ring segment and a radius between the central axis and the groove decreases from the entrance to the exit.

10. The die according to claim 9, wherein the groove has a last portion located at the exit and the radius between the central axis and the groove is constant over the last portion of the groove.

11. A curling apparatus for curling outer peripheries of container shells comprising:

an inner ring having an outer surface and a groove in the outer surface, the inner ring groove extending the entire periphery of the inner ring;

an outer ring-segment having an inner surface and a groove in the inner surface, the outer ring-segment groove extending the length of the outer ring-segment, the outer ring-segment partially encircling the inner ring with the inner ring groove facing the outer ring-segment groove;

an adjustment device adapted to selectively move the outer ring segment relative to the inner ring to adjust a distance between the inner ring groove and the outer ring-segment groove at a desired location along the outer ring-segment groove, the adjustment device including a rotatable cam member;

wherein the cam member is rotatable about a generally vertical axis; and wherein the cam member is located within a vertically extending opening in the outer ring-segment.

12. The curling apparatus according to claim 11, wherein the opening is a slot.

13. The curling apparatus according to claim 11, wherein the adjustment device further includes another rotatable cam member located at an opposite side of the outer ring-segment from the rotatable cam member.

14. The curling apparatus according to claim 11, wherein the outer ring-segment has a unitary length extending about 240 degrees.

15. The curling apparatus according to claim 11, wherein the outer ring segment is unitary and the outer ring-segment groove is eccentric.

16. A curling apparatus for curling outer peripheries of container shells comprising:

a plurality of inner rings vertically stacked, each of the inner rings having an outer surface and a groove in the outer surface, each inner ring groove extending an entire periphery of the inner ring;

a plurality of outer ring-segments vertically stacked, each of the outer ring-segments having an inner surface and a groove in the inner surface, each outer ring-segment groove extending the length of the outer ring-segment, the outer ring-segments partially encircling the inner rings with the inner ring grooves facing the outer ring-segment grooves; and plurality of adjustment devices adapted to selectively move the outer ring segments relative to the inner rings to adjust a distance between the inner ring groove and the outer ring-segment groove at a desired location along the outer ring-segment groove, each outer ring-segment having one of the adjustment devices associated therewith, each adjustment device including a cam member rotatable about a vertical access and located within vertically extending openings in the outer ring-segments.

17. The curling apparatus according to claim 16, wherein one of the openings associated with the cam member is in an associated outer ring-segment and is engaged by the cam member and remaining openings associated with the cam member are clearance openings.

18. The curling apparatus according to claim 16, wherein the outer ring-segments are secured with common mounting fasteners which extend through clearance openings in each of the outer ring-segments.

19. The curling apparatus according to claim 16, wherein each of outer ring-segments has a unitary length extending about 240 degrees.

20. The curling apparatus according to claim 16, wherein each of the outer ring segments are unitary and the outer ring-segment grooves are eccentric.

21. A curling apparatus for curling outer peripheries of container shells comprising:

an inner ring having an outer surface and a groove in the outer surface;

wherein the inner ring groove extends the entire periphery of the inner ring;

a unitary outer ring-segment having an inner surface and a groove in the inner surface;

wherein the ring segment has a length extending in the range of about 120 degrees to about 300 degrees;

wherein the outer ring-segment groove extends the length of the outer ring-segment, wherein the outer ring-segment groove has an entrance at a first end of the outer ring-segment and an exit at a second end of the outer ring-segment and a radius between the central axis and the groove decreases from the entrance to the exit;

wherein the outer ring-segment is concentric with the inner ring and partially encircles the inner ring with the inner ring groove facing the outer ring-segment groove.

22. The die according to claim 21, wherein the outer ring-segment groove has a length extending about 240 degrees.

23. The die according to claim 21, wherein the groove has a last portion located at the exit and the radius between the central axis and the groove is constant over the last portion of the groove.

* * * * *